United States Patent [19]

Egger et al.

[11] Patent Number: 4,688,336

[45] Date of Patent: Aug. 25, 1987

[54] TEMPERATURE-CONTROLLING MACHINE

[75] Inventors: Friedrich Egger, Niederuzwil; Andreas Gautschi, Hauptwil, both of Switzerland

[73] Assignee: Gebrueder Buehler AG, Uzwil, Switzerland

[21] Appl. No.: 731,623

[22] PCT Filed: Sep. 12, 1984

[86] PCT No.: PCT/EP84/00279

§ 371 Date: Apr. 30, 1985

§ 102(e) Date: Apr. 30, 1985

[30] Foreign Application Priority Data

Sep. 22, 1983 [CH] Switzerland ..... 5164/83

[51] Int. Cl.[4] ..... F26B 17/18

[52] U.S. Cl. ..... 34/109; 34/126; 34/130

[58] Field of Search ..... 34/109, 126, 130, 135, 34/139, 142

[56] References Cited

U.S. PATENT DOCUMENTS 1,711,188 4/1929 Triulzi ..... 34/109

FOREIGN PATENT DOCUMENTS

| | | |
|---|---|---|
| 320526 | 4/1920 | Fed. Rep. of Germany . |
| 693641 | 6/1938 | Fed. Rep. of Germany . |
| 1729402 | 1/1975 | Fed. Rep. of Germany . |
| 888387 | 12/1943 | France . |
| 905375 | 12/1945 | France . |
| 1019408 | 6/1950 | France . |
| 427072 | 11/1947 | Italy . |
| 512118 | 1/1955 | Italy . |

*Primary Examiner*—Albert J. Makay
*Assistant Examiner*—David W. Westphal

[57] ABSTRACT

A machine for heat and/or cold treatment of lumpy material, more particularly a drum dryer for pasta, has a number of chambers (6) distributed around the drum periphery. Each chamber (6) is bounded in known manner at the inner and outer drum periphery by a perforated wall (8, 10) to enable air or another treatment gas to flow through. At least one perforated wall (8, 10) is associated with a retaining device, more particularly a tensioning device, at least one of the perforated walls (8, 10) and preferably at least the outer wall (10) being divided in the axial and/or peripheral direction around the drum periphery. Advantageously each chamber (6) is associated with a separate perforated wall (10) which can be tensioned by a tensioning device.

9 Claims, 10 Drawing Figures

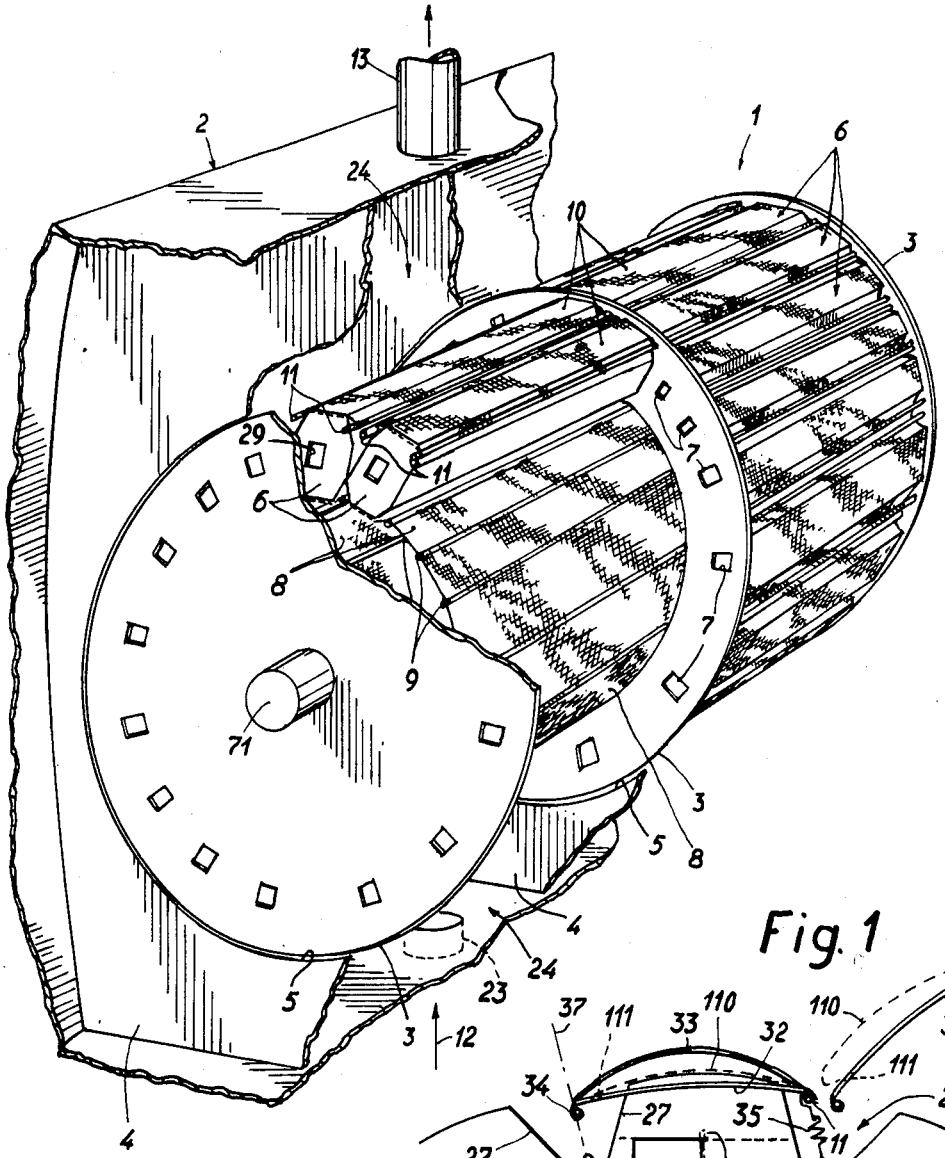
Fig. 3
Fig. 1
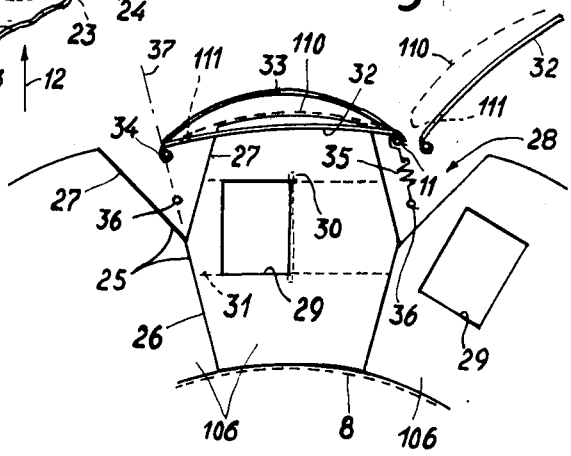

TEMPERATURE-CONTROLLING MACHINE

The invention relates to a temperature-controlling machine for material in lumps, preferably a dryer, more particularly for pasta, comprising a drum having a number of peripheral chambers with conveying devices for the processed material, the chambers being surrounded by a wall, two opposite portions of which face the walls of neighbouring chambers and two other portions are associated with the outer periphery and an inner periphery of the drum, at least the last wall portions having perforated walls.

A past dryer of this kind is known from IT-PS No. 512 118. Although we are speaking here about a temperature-controlling machine in general, we mean that a machine of this kind is of course also suitable for cooling and for any kind of heat or cold treatment in general. The use of such machines is therefore not restricted to pasta; they can also be used for heattreatment of products such as nuts or beans of all kinds, or for mineral material in lumps. In known machines of this kind, the conveying device in each chamber comprises a sort of screw formed by suitably shaped walls but disposed immovably in the chamber and only rotating eccentrically around the drum axis at each rotation of the drum. As a result, the lumpy material moves by gravity along the screw pitches, resulting in gentle conveying and reducing the risk of squashing or excessive wear. However, there are also some known pasta dryers in which a driven screw is disposed inside each chamber, in which case the chambers are usually cylindrical.

In each case, however, the individual chambers are disposed at the drum periphery, leaving a cavity at the centre of the drum. This cavity is equal in size to the inner diameter of the drum and is separated from each chamber by a perforated wall, in the same way as at the outer drum periphery. Consequently each chamber forms an outward duct for drying air, which usually flows transversely through the drum. In the Italian specification, the perforated wall at the outer and inner drum periphery is secured to the chamber casing. If the material sticks, therefore, access to the inside of the casing is made difficult, with the result that cleaning becomes practically impossible. In the case of shelf pasta dryers without a conveyor, lateral covers have already been proposed for the individual shelves bounded by perforated walls (German PS No. 320 526) but the covers have not given good results, because they almost inevitably leave cracks through which the material for drying can penetrate and foul up the machine or where the material is trapped and inadequately ventilated and consequently inadequately dried. If the still-pasty material returns to the chamber, it can stick and foul up the inside.

The aim of the invention is to ensure easy access to the interior of the chamber, thus facilitating cleaning, and also to provide simple operating means for this purpose. Another aim is to simplify the assembly process.

To this end, according to the invention, a perforated wall which can be brought from a closed position into an open position raised from the other wall portions is provided on at least one drum periphery, and a retaining device and a tensioning device are provided for the perforated wall. Consequently the screen can be made accessible from all sides simply by releasing the tensioning device, after which the removable perforated wall is either pivoted around the retaining means or taken out from it.

According to the invention, a special perforated wall is preferably provided for co-operating with the retaining device, characterised in that it has, at least at one end, at least one opening for engaging a retaining device. The retaining device on the screen side then co-operates with the retaining device on the machine side and/or the tensioning device.

Another method of solving the previously-described problem by the idea of subdivision or easy removability is as follows: the drum, between plates at its two ends, is subdivided at least once by an additional plate in the axial direction, advantageously into equal-sized portions, the chambers are correspondingly guided into elements, a transfer device is provided at the partition plate for the material flowing through the chamber elements parallel to the drum axis, and connecting devices which can be non-destructibly released are provided respectively for the plates and chamber elements. The result is an easily-assembled and easily dismantled construction of individual components which are advantageously all of the same size, so that an existing machine can be extended when required. Dismantling for cleaning purposes is also made easier. The connecting devices can without difficulty be designed to produce reinforcement between the individual components (plates and chamber elements), so that the construction is at least partly self-supporting and a separate bearing structure can be made cheaper or completely eliminated. This not only reduces the manufacturing costs but also reduces the weight of the entire machine, thus reducing energy costs for the rotary drive. The plates can without difficulty be made wide enough for a friction-roller drive via their outer periphery, in which case, as a result of the delivery devices provided, the plates do not interfere with the flow of material in spite of their relatively large diameter. The delivery devices can be constructed so as to empty the material at the end of one chamber element and pour it via a filling device into the next chamber element. In the simplest case, however, the delivery device is simply an opening in the partition plate connecting the two chamber elements.

According to another feature, to obtain still higher efficiency, more particularly better drying but at lower temperatures, thus saving energy, the drum is disposed in a treatment chamber in which at least one flow generator for circulating the gas is disposed in addition to the continuous-operation devices so that the flow can be sent at least once through the perforated wall covered with material, of some of the chamber disposed around the periphery of the drum. This ensures that the continuously-supplied gas (usually air but possibly also steam or an inert or treatment gas) does not flow through once only so as to be partly wasted, but is also circulated in the treatment chamber. As a result of the drum rotation, only a part of the chambers will have a perforated wall completely covered with material. Consequently, the circulating gas can flow through at the place of least resistance, i.e. where the material only partly covers the perforated wall and leaves a substantially free channel alongside. Advantageously the flow generator is disposed so that the flow is guided precisely through those chambers where the perforated walls are covered with material. This can be done in various ways, e.g. by disposing a blower near the chambers so as to exert suction or pressure through the chambers; in the case of an axial blower its axis will extend substantially radially to the drum.

It has been found, however, that a more uniform gas supply and a better effect can be obtained if the circulating-air flow generator is a blower with its axis of rotation extending substantially parallel to the tangent at the drum.

Particularly advantageous gas distribution is obtained if the flow generator is disposed at an angle, e.g. of about 45°, to the flow direction of the gas, relative to a cross-section through the drum, and is preferably disposed together with a second similar flow generator on a plane extending through the drum axis, This ensures that continuous operation and circulating operation do not interfere with one another but on the contrary are complementary. This results in even better use of the gas supply and higher efficiency.

Advantageously, to avoid flow losses and shortcircuits, the flow generator is associated with at least one guide surface, i.e. at its side facing the chambers filled with material covering the perforated wall, so as mechanically to convey the circulated gas. A similar guide surface can be disposed at the opposite side, but will be of little use; in any case a guide surface will be automatically present if the aforementioned second flow generator is provided, since the latter's guide surface at the side facing the chambers will have a back which advantageously also forms the guide surface for the other flow generator at the side remote from the filled chambers.

Other details will be clear from the following description of embodiments diagrammatically shown in the drawings, in which:

FIG. 1 is a perspective view of a temperaturecontrolling machine according to the invention, individual parts being omitted;

FIGS. 3 and 4 show various embodiments of the chambers and perforated walls;

Figure 2:
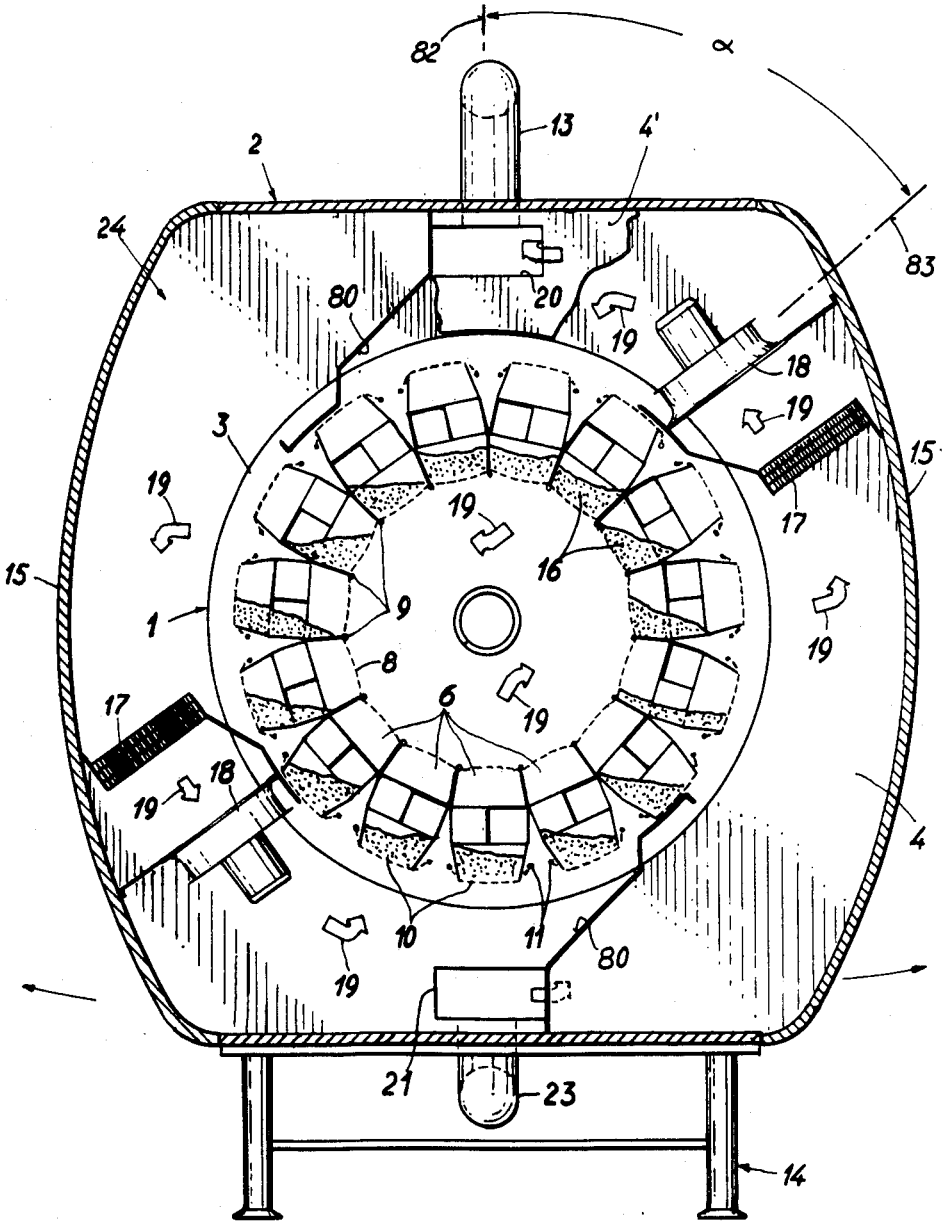
FIG. 2 is a cross-section through a modified embodiment.

In FIG. 1 a drum 1 is mounted (details not shown) in a casing 2. Drum 1 is divided at preset, preferably equal distances by plates 3. At the sides of the casing, each plate 3 is closely surrounded by an intermediate wall 4. During assembly, each plate 3 can be inserted into the surrounding opening 5 in wall 4, or wall 4 is divided and assembled only after inserting plate 3. If required, plate 3 can have a groove and/or spring in its outer periphery, engaging in a corresponding groove or recess in wall 4, to ensure better sealing-tightness between the chambers formed by plates 3 and walls 4. If required, springs and grooves can be produced by forming plates 3 and/or walls 4 from a number of layers individual layers having a recess or projecting to form a spring.

At its periphery, drum 1 bears a number of box-like chambers 6. Each chamber 6 contains a conveyor, which can be driven as previously described or can be purely passive and effectively driven by the drum rotation, but in both cases conveys the material for treatment (usually pasta) at uniform speed along each chamber 6.

As can be seen, chambers 6 are disposed in alignment in adjacent drum portions separated by a plate 3 so that the material for drying at the end of a chamber 6 in the rear drum portion (in FIG. 1) travels through one of the openings 7 into a chamber 6 into the front drum portion. In the next drum portion, the material then runs through the corresponding chamber 6 and out through the front plate 3, where suitable devices are provided for removing the dried material. Such devices are known from the prior art and do not need to be described in detail. We shall only mention that it is also known to remove dried material from the drum interior, which is quite within the range of possibilities here. It is only necessary for the screen netting 8 bounding the drum inner periphery to be made somewhat narrower so that the space left between its edge and the adjacent plate 3 is sufficient for the dried material to fall out of an opening at the edge of the underside of each chamber 6. Alternatively the outlet opening can be formed near the outer periphery of drum 1, in which case the dried material falling out will be collected below the drum.

One advantage of dividing the drum 1 is that, by means of the walls 4, different air conditions can be produced in separate treatment chambers. In addition, even if the drum 1 is relatively long, chamber 6 remain relatively easy to handle and can therefore be easily removed for cleaning purposes if required, without the need for a lifting tool. In this manner, if required, a large number of different treatment chambers can be produced, through which the material runs in succession, and if required the drums can also be stored on rolling bearings disposed in the spaces between walls 4 and plates 3. This has the advantage of correspondingly reducing the pressure per unit area at the outer periphery of plates 3. Drum 1 may also be driven via plates 3, in which case plates 3 advantageously project at least beyond openings 7 and preferably beyond the outer diameter of chamber elements 6.

The screen netting 8 bounding the inner periphery of drum 1 is disposed over rods 9 secured between each pair of plates 3. In the illustrated embodiment, the inner perforated wall comprises a single net 8 common to all the chambers 6 disposed on drum 1. A specially advantageous embodiment, however, is shown for the outer perforated wall. In this case each chamber 6 is associated with a separate perforated wall 10, the lateral ends of which can be secured to the casing of each chamber 6 by rods 11 which extend through the netting. Details of this operation will be explained hereinafter with reference to FIGS. 3–7.

Since drum 1 has perforated walls, it is of course permeable to air at its inner and outer periphery transversely to its axis, so that a treatment gas, usually hot air, can be blown in e.g. at the underside into each chamber in the direction of arrow 12, and removed at the top, e.g. through a pipe 13. Examples of guiding the treatment air will be explained hereinafter with reference to FIGS. 2 and 8.

In FIGS. 2, parts having the same function are indicated by the same reference numbers. Parts having a similar function are similarly indicated but with the number increased by one or more hundred. As shown in FIG. 2, drum casing 2 is mounted on a frame 14. To facilitate access to the interior of each treatment chamber or drum 1, the side walls 15 of casing 2 can be opened out in a manner indicated by arrows. To this end, hinges (not shown) are provided at the top of casing 2. The drawing also shows how the material 16 for drying is rotated in chambers 6 when drum 1 rotates, and in the process is of course conveyed along the previously-mentioned active or passive screwthreads.

In the embodiment in FIG. 2 there are two units, each comprising a heating member 17 and a blower 18, for heating the circulating air. Accordingly, the air in each chamber is circulated in the direction of arrows 19 and heated by device 17. The treatment chamber has an inlet opening 20 at its front wall 4' and an outlet opening 21 at its rear wall 4. These openings 20, 21 can be used for connecting to the neighbouring chambers, provided the openings are not closed as will be described hereinafter with reference to another embodiment in FIG. 8. A connection to non-neighbouring chambers can also be made by switching over suitable valves (see FIG. 8), the heated air being guided along pipes 13 or 23. This method can be used e.g. by treatment in counter-current, in which air charged with moisture is sent in the opposite direction to the material for drying. Alternatively all the openings can be closed so that each chamber 24 can be separately and independently conditioned with circulating or continuously-flowing air.

Note that the flow path for continuous-air operation is along the axes of pipes 23 and 13 and openings 20 and 21. This ensures that air in continuous operation is always conveyed through chamber elements 6 in the top and bottom quarter of drum 1. It is precisely in these quarters that the perforated walls 10 of elements 6 are completely covered by material 16, thus ensuring that air cannot flow wastefully past the material. Even if chamber 24 is made narrow, however, there is still enough room for the air to escape.

To make better use of the circulating air, blowers 18 are designed as circulating blowers and disposed at an angle to the vertical 82 so that the circulating air flow does not interfere with the continuous vertical air flow. On the contrary, as arrows 19 show, the circuit is undisturbed; even in circulating operation the air is driven by blowers 18 in the direction of arrows 19 through elements 6 in the top and bottom quarter, whereas at the side, where the screens of chambers 6 are not completely covered by material 16, the air can flow past the material and thus dried less intensively.

When the two blowers are disposed as illustrated on a plane 83 extending through the drum axis at an angle (e.g. 45°) to the vertical 82 (the direction of continuously-flowing air), the continuous air will also influence the circulating air by directing it towards the bottom and top chamber elements 6. Advantageously, however, the circulating air is mechanically guided by guide plates 80, which prvent the circulating air from escaping and force it through the top and bottom elements 6. The angle between planes 82 and 83 is indicated by $\alpha$ in FIG. 2.

Although the illustrated arrangement is very advantageous, modifications can of course be made. For example there can be a different number of blowers 18 or only one blower. The preferred axial blowers can be replaced by radial or transverse blowers, or special flow-producing nozzles can be installed.

FIG. 3 shows a first embodiment of box-like chambers 106 distributed round the drum periphery and having an approximately polygonal cross-section. The wall portion 25 facing each neighbouring chamber 106 is bent and extends so that a radially inward portion 26 extends parallel to the corresponding wall of the neighbouring chamber 106. This ensures that the gap between adjacent chambers 106 is negligibly thin, thus forcing the air to flow through the inner perforated wall 8, round the material for drying in each chamber 106, before flowing out of the outer perforated wall 110.

The radially outer part 27 of wall portion 25 is at an angle to part 26 so as to leave a space 28 between adjacent portions 27 of neighbouring chambers 106. Space 28 can be used for a retaining device and a clamping device for each perforated wall 110, which in the illustrated embodiment is associated with only one chamber 106.

The outlet opening 29 of each chamber 106 can be a slot extending from a middle wall 30 to the side wall portion 25. As a result the opening 29 will deviate from a rectangular shape, which may be undersirable. In order therefore to supply material for drying to a rectangular outlet opening 29 (as shown), an oblique wall 31 (indicated by chain lines) can extend from the side wall portion 25 to the outlet opening 29.

In the present embodiment, the inner perforated wall 8 can be laid over cylindrical curved members (not shown) defining the inner drum periphery, so that wall 8 will have a substantially complete cylindrical surface. In that case it may be advantageous if the casing of each chamber 106 is made concave at its side adjacent wall 8, as shown in FIG. 3.

In this embodiment, of course, the individual chambers 106 must be tensioned very strongly against the inner perforated wall 8, to avoid forming a gap. To this end, the tensioning device (described hereinafter) for the outer wall 110 can also be used to press the inner wall 8 against the casing of each chamber 106.

Wall 110 is held and tensioned by a rectangular frame extending over the entire casing 2 (see FIG. 1), comprising two rods 11, 111 and a curved spring 32 at each end of a chamber 106. To provide space for member 32, the casing can have a small recess at its top, or alternatively each plate 3 can be given a corresponding lateral slot. Members 32 also help to tension the netting forming the perforated wall 110. Since chambers 106 can be relatively long as shown in FIG. 1, it may be advantageous to provide additional curved springs 33, projecting beyond wall 110, between the opposite ends of each chamber 106.

Each member 32, 33 is pivotable around an axis 34 from an illustrated closed position shown relative to the central chamber 106 in FIG. 3, into an open position shown for the right chamber 106. In the open position, screen 110 may be released as illustrated or alternatively can be tensioned by its own elasticity, depending on the amount of bending chosen for member 32.

Wall 110 is clamped in its closing position by a device which in the simplest case comprises a tension spring 35. FIG. 3 shows only individual springs 35, but in most cases of course at least two springs 35 will be disposed at each end of a chamber 106 and perhaps also in between. Each spring 35 engages an anchoring pin 36 secured to a plate 3 whereas its other end is suspended from rod 11, which co-operates with rod 111 to form the retaining device.

This construction ensures that the outer wall 110 is always clamped to each chamber casing, witout leaving a gap. The construction also ensures that wall 110 can be opened simply by removing device 35, so that each chamber 106 is easily accessible for cleaning. This also makes it easy to remove an individual chamber 106 from the drum periphery, so as to clean the inner perforated wall 8. Handling is additionally simplified by the longitudinal division of chambers 106 by plates 3.

The novel use of a single chamber 106 is also improved by the illustrated polygonal shape, because the substantially radial wall portions 26 of adjacent chambers act as guide surfaces. As a further aid, the pivot axis 34 of members 32 and 33 and anchoring pin 36 lie along a radial line 37.

Figure 4:
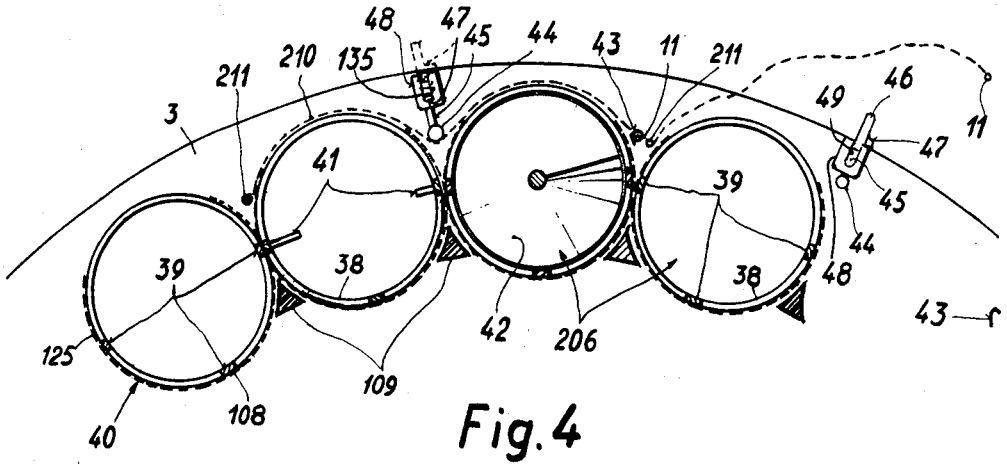

According to the invention, the prismatic chambers 6, 106 can be replaced by cylindrical chambers 206 as in FIG. 4. In that case, approximately triangular rods 109 with concave limbs for holding cylindrical chambers 206 can be secured between adjacent plates 3. Each chamber 206 comprises a number of longitudinally distributed cylindrical curved members 38 between which longitudinal struts 39 (e.g. three of them) run. Screen netting 40 is tensioned or held around members 38 by known means (not shown). Netting 40 extends at least over an inner wall portion 108 and may if required extend over a side portion 125. Alternatively, portion 125 may be made of material not permeable to air.

Note that for a number of reasons, the illustrated cylindrical form is not the preferred embodiment. For one reason, in the present case the lateral seal between adjacent wall portions 125 is not so good, with the result that air may escape sideways without coming into contact with material for drying inside the chambers 206. To improve sealing-tightness, the limbs of the equilateral triangular-cross-section rods 109 can be made relatively long to produce a certain sealing effect. In this manner, rods 109 will serve the multiple purpose of retaining chambers 206, guiding them when a chamber is taken out and a new chamber is inserted, and sealing in the neighbourhood of portions 125. Another reason for not preferring cylindrical chambers 206 is that when the drum rotates, the material inside for drying tends to slide along the cylinder walls, producing increased wear or non-uniform drying. In order to turn the material by tumbling it, baffles 41 can be incorporated in known manner inside chambers 206, and will preferably extend from the longitudinal struts 39.

These baffles, however, cannot ensure that the drying material will also move along chambers 206. To produce longitudinal motion, baffles 41 will either be helical (in the case of a passive conveyor) or each chamber outlet will be connected to a suction conveyor. Another possibility is for a screw 42 driven by planetary gear in known manner (not shown) to be disposed in known manner inside each chamber. As already mentioned, however, a conveyor screw 42 may easily squash or increase the wear on the processed material. Another result of course will be to make it more difficult to dismantle chambers 206, because they cannot be taken from their seat on rods 109 before the bearings for screw 42 are opened. In addition, a screw 42 has an appreciable weight, and is thus more difficult to handle.

In spite of the various disadvantages of cylindrical chambers 206, the inventive construction can produce some improvement in the accessibility of the chambers. In the embodiment in FIG. 4, each pair of adjacent chambers 206 has a common net 210 forming the perforated wall. If required, of course, the net can extend over more than two chambers or even over the whole drum. Of course, a similar net construction can be used for polygonal chambers.

Net 210 is in the form of frameless screen netting with retaining rods 11, 211 at its two ends as in FIG. 1. Rod 211 can be secured to plates 3 whereas rod 11 is suspended in a hooked retaining device 43 on plate 3. In contrast to FIG. 3, the tensioning device does not engage one end of netting 210 but in the centre between two chambers 206. The tensioning device comprises a rod 44 extending not necessarily over the entire length of chamber 206, the end of rod 44 near plate 3 being connected to a push rod 45. Push rod 45 is advantageously divided into two and, as shown on the right side of FIG. 4, has connected thereto a top sleeve part 46 which is rotatable but not axially movable relative to push rod 45. A catch 47 is attached to sleeve part 46.

Push rod 45 slides in a housing 48 containing a compression spring 135. Spring 135 normally presses push rod 45 radially inwards, so that rod 44 is pressed against net 210 and catch 47, on sleeve part 46, slides in a slot 49 in housing 48. In order to remove wall 210, rod 44 is brought against the pressure of spring 135 into the position shown in dash lines (or in solid lines on the right of FIG. 4) and sleeve 46 is rotated through 90° so that catch 47 bears on the wall of housing 48 and thus prevents the rod 44 from return movement under pressure of spring 135. After being thus released netting 210 can easily be gripped at rod 11 and removed from the hook-like retaining device 43. As shown on the right of FIG. 4, a radially outward opening of chamber 206 is then uncovered, so that the interior can be cleaned or chamber 206 can be removed from the supporting triangular rods 109.

Figure 5A:
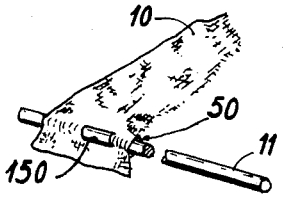
FIGS. 5A and 5B show two different embodiments of a screen for the perforated wall.
Figure 5B:
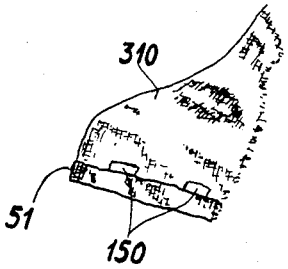

In order to produce a frameless perforated wall of this kind, as shown in FIGS. 5A and 5B, netting 10 or 310 is advantageously formed with openings 50 or 150. Netting 10 (FIG. 5A) is a double net with a pocket-like opening 50 through which rod 11 can be inserted. In this construction the tension is relatively uniformly distributed, eliminating the need for special precautions for strengthening the edge. In the embodiment in FIG. 5B the edge 51 must be reinforced, since the spaced-apart openings 150 are to be used for suspending tension springs 35 (see FIG. 6) or other tensioning devices. In this case, tension is applied substantially at a point at each opening 150, and therefore the edge must be reinforced, e.g. by inserting flat bars. In order to use a net 10 (FIG. 5A) on various devices, they can likewise be formed with openings 150 so that, depending on the construction of the machine, either a rod 11 can be inserted into opening 50 or corresponding retaining and tensioning devices can be suspended in openings 150. Alternatively, openings 150 in net 10 in FIG. 5A can be used for securing a number of tensioning and/or retaining devices distributed along rod 11. In the case of netting 10 suitable for various machine constructions, a reinforced edge 51 will advantageously be provided as per FIG. 5B.

Figure 6:
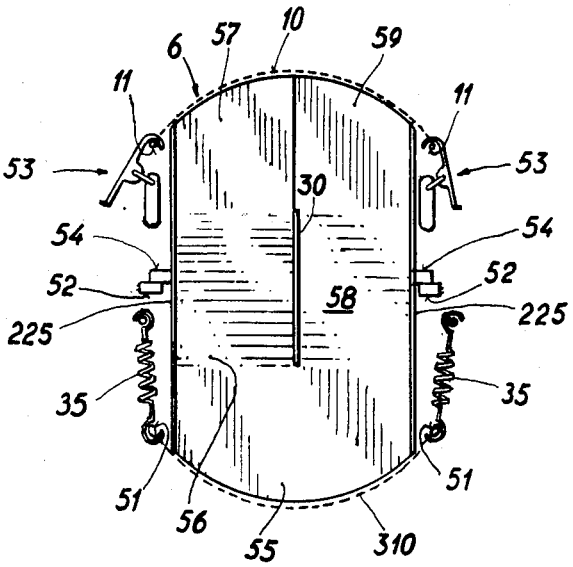
FIGS. 6 and 7 show various other embodiments.

FIG. 6 shows how a net 310 as per FIG. 5B can be disposed as the inner perforated wall of a chamber 6, by attaching tension springs 35 to the reinforced edge 51. As can be seen, the inner perforated wall need not necessarily be a net common to all chambers, but can if required be constructed exactly as described previously (and also hereinafter) with reference to the outer perforated wall. Preferably, however, at least the outer wall is divided into a number of angular portions round the outer drum periphery, each chamber being preferably associated with a separate perforated wall.

When chamber 6 is assembled (FIG. 6) net 310 is first suspended by springs 35 which engage anchoring pins 36. Next, chamber 6 is inserted between two abutments 52 secured to plate 3. If required, abutments 52 can have funnel-shaped tapering blanks for more accurate guiding of chamber 6. Next, the outer net 10 is placed on top and pulled down by quick-acting tensioning fasteners 53 secured to rods 11 and anchored to the plate 3. In this process, fasteners 53 pull against the action of springs 35, which are therefore tensioned more strongly, until co-operating abutments 54 on the chamber casing touch the abutments 52. In this manner, springs 35 co-operate with fasteners 53 to form a common device for clamping both perforated walls 10, 310, and the guiding abutments 52, 54 ensure that the inlet and outlet openings (see openings 29 in FIG. 1), are on exact alignment with openings 7 of plates 3. Lateral alignment will be facilitated by providing the mentioned funnel surfaces on abutments 52, and in any case abutments 52 are disposed very close to the side wall portions 225 of the chamber casing.

In the embodiment in FIG. 6, chamber 6 is shown with tension fasteners 53 in "open" position and in known manner, to define a conventional screw-like passive conveyor within chamber 6, the latter has walls consisting of five flat portions. The lower flat portion 55 extends substantially perpendicular to the longitudinal axis of chamber 6 (compare FIG. 7A) over both chamber halves separated by the central wall 30, whereas the adjacent section 56 on the left (shown in darker shading) extends from below and further inwards (relative to the plane of the drawing) upwards and outwards until, after one turn, the resulting screw abuts a wall 57 lying in a plane parallel to wall portion 55.

A sloping inwardly extending wall portion 58 (see FIG. 7A), shown in lighter shading, extends on the right side from the bottom wall portion 55 and, at one turn of the screw from wall portion 57, is adjacent a parallel wall portion 59. As can be seen, the top and bottom of the chamber casing is advantageously rounded, to ensure more uniform tension on netting 10 or 310. The rounding can be circular, but the best uniformity is obtained from a parabolic curve.

Figure 7A:
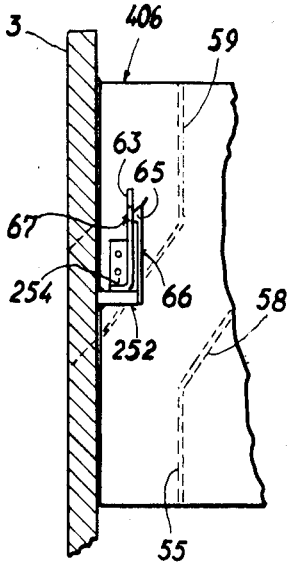
FIG. 7A is a side view of one of the embodiments in FIG. 7.
Figure 7:
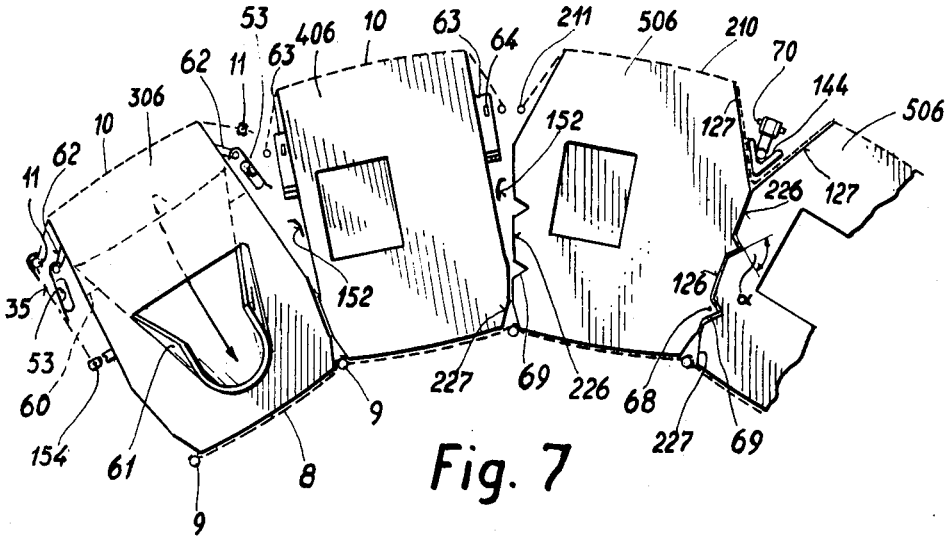

FIG. 7 shows other possible embodiments with reference to chambers 306, 406 and 506, chamber 406 being shown in side view together with a drum plate 3 from FIG. 7A. Usually the chambers on a drum have the same shape, but FIG. 7 shows variously-shaped drums 306 to 506 in order to illustrate different embodiments and also show that differently-shaped chambers can be disposed adjacent one another if required.

In contrast to the known screw-like passive conveyor disposed inside chamber 6 as described with reference to FIG. 6, chamber 306 has a passive conveyor (i.e. acting only via the drum rotation) which is constructed in the manner disclosed from IT-PS No. 427 072. In the present case, the chamber is divided by a number of partition walls 60, from which oblique channel-like conveying slides 61 project. Material for drying slides down the channel and, during the next halfrotation of the drum, reaches the upper region, from which it slides through the next channel into the next chamber.

In order to clamp wall 8 between rods 9, the casing of chamber 306 can have lugs 62 engaging diagrammatically shown tension fasteners 53 of known construction (compare FIG. 6). This also brings chamber 306 into alignment with the chambers on the other side of the drum plate; as before, abutments 154 can be provided corresponding to abutments 54 in FIG. 6 (only one abutment 154 is shown).

Abutment 154 in FIG. 7 is shown exploded, since it fulfills another function, i.e. is used for securing a tension spring 35 for engaging a retaining rod 11 of the outer perforated wall or netting 10. The same method can be used for the retaining rod 11 at the other end, or alternatively, on the right side (relative to FIG. 7) rod 11 can be combined with lug 62, and thus serves the double purpose of engaging the fastener 53 there, another consequence being that netting 10 is not releasable from chamber 306 until the rod has been disengaged from lug 62. This example shows that the perforated wall or netting N need not necessarily be secured to a retaining device on the plate; the retaining device may as well be provided at the casing itself. Abutment 154 is of course associated with a corresponding counter-abutment (not shown). Chamber 406 shows a possible embodiment of the funnel-shaped side flanks of a counter-abutment 152. In this embodiment, however, it acts only as an aid in centering, because a stationary counter-abutment 252 has been welded on to plate 3 as shown in FIG. 7A. Abutment 252 co-operates with an abutment 254 permanently secured to the chamber casing and provided with an angle plate 63. Plate 63 has a slot opening 64 in which a catch 65 engages. Catch 65 is formed on a spring arm 66 secured to abutment 252. As FIG. 7A shows, the lower surface 67 of catch 65 is somewhat bevelled, to allow for manufacturing tolerances, so that surface 67 always abuts the lower edge of opening 64 (see FIG. 7). In this manner, chamber 406 is secured in a position in which the two abutments 252, 254 are adjacent. Chamber 406 can be released from plates 3 simply by pulling the snap-fastener catch 65 out of opening 64 in plate 63. If required, catch 65 can have a locking device in order to hold it open against the action of its spring arm 66.

Of course, the embodiment in FIG. 7A is only a particularly advantageous example where the individual elements 6 or 406 can be rapidly unfastened or fastened to the corresponding plates 3 by the illustrated quick-acting coupling. The illustrated centering device not only ensures a correct fit but also and ultimately produces a relatively rigid construction in which elements 6 form reinforcing ribs between plates 3. In cases where higher requirements on rigidity and strength are made, i.e. more particularly for longer machines with more than one plate 3 between the two end plates (see FIG. 1), a different kind of releasable connection, e.g. a screw, may be preferred. In all cases, however, the bearing construction can be omitted or can be weaker. This unit-construction system not only simplifies assembly but also enables each machine to be easily extended, thus simplifying and reducing the cost of production and storage.

In the case of chamber 406, the retaining device and the tensioning device for the perforated wall 10 are not shown in detail and can be constructed as per one of the previously-described embodiments.

Chambers 506 show how the sealing effect at the parallel, substantially radial side wall portions 126 can be improved by a sort of labyrinth construction. To this end the wall portion 126 towards the right in FIG. 7 has projections 68 which engage in corresponding recesses 69 in the neighbouring wall 226. This construction improves sealing and also fixes each chamber 506 in position relative to the neighbouring chambers, so that the system is more stable. Projections 68 and recesses 69 (which need not be triangular but can have other shapes, e.g. can be corrugated) form reinforcing beads for the side wall portions 126 and 226, so that these portions can be made of weaker material if required.

This saves expense and more particularly reduces the total weight of the machine. In order not to indent wall portions 126, 226 too abruptly so that it is more difficult to take individual chambers 506 out, the porjections 68 and recesses 69, which are preferably rounded, should have an opening angle $\alpha$ which is greater than 45° and preferably approx. 60°.

The present embodiment, like FIG. 4, comprises a perforated wall 210, which is firmly secured at one end e.g. to a rod 211, extends over a number of chambers 506 and is secured at the other end either by tensioning device or a retaining device corresponding to the retaining device 43 in FIG. 4. As already shown in FIG. 6, the retaining device acting on one end and the tensioning device acting on the other end can each be of similar construction. One contrast to the preceding embodiments, however, is a tension arm 144 pivotable around an axis 70 and biased against chambers 506 by a spring (not shown). In contrast to the round rod 44 in FIG. 4, arm 144 is V-shaped as shown, the limbs of the V extending parallel to the side wall portions 127 of the chambers. In this manner, screen 210 is tensioned between the two chambers 506 and also holds chamber 506 in position.

Figure 8:
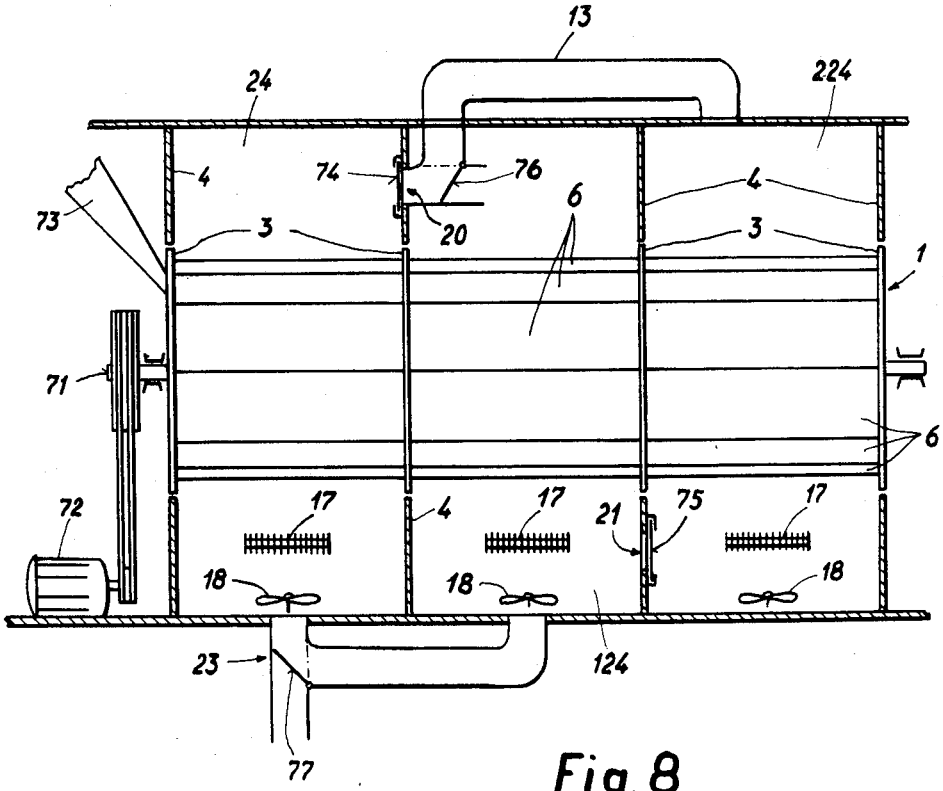
FIG. 8 is a longitudinal view, diagrammatically showing a machine divided into a number of treatment zones.

FIG. 8 shows thre adjacent treatment chambers 24, 124, 224 separated by drum plates 3 and walls 4. As already explained, this feature is used for obtaining different climatic areas for the treated material. Accordingly, each chamber 24, 124, 224 has a separate unit 17, 18 for heating and distributing air or, if required, steam (e.g. for shelling products such as soya beans). Drum 1 is driven via shaft 71 by a motor 72; alternatively the drive can be via rings round the drums, as already proposed in IT-PS No. 427 072. The material for treatment can be supplied to the individual opening 7 (see FIG. 1) in plates 3 by a chute 73, and a similar chute (not shown) can be provided at the opposite side of drum 1.

The following is a description of various connecting and switching possibilities for operating the chambers 24, 124, 224, which can be used together or alternatively at each chamber. Particular attention must be paid to efficient use of waste heat, either by counter-current operation or by fully using the heat via appropriate heat exchangers.

Openings 20, 21 already discussed in connection with FIG. 2 are shown in the walls 4 of the central treatment chamber 124. The two openings 20, 21 can be blocked if required by a slider 74, 75 respectively. Chambers 24 and 124 can be connected by opening slide 74 and moving a valve 76 into its dot-dash position, so that both chambers can be operated e.g. with circulating air. To this end only one of the two blowers for these chambers needs to be put into operation, or one blower 18 can suck air out of the associated chamber and the other can blow air. Advantageously, therefore, the direction of rotation of the blowers can be changed for different forms of operation. Alternatively a valve 77 can be brought into a mid-position between the solid line and the dot-dash position, so that a certain quantity of fresh air or other gas, e.g. stream, can be supplied in addition to the circulated air. If valve 77 is moved into the dot-dash position, fresh air can continuously be sucked in to chamber 24; when for example slide 74 is open and valve 76 is in its solid line position, air is supplied through pipe 13 to chamber 224 or can be blown out (not shown). In any case, the diagram in FIG. 8 shows that the air conditions in chambers 24, 124 224 can be varied as required by varying the pipe connections and/or valve or slide positions. For example, chamber 24 can be designed for strong heating, chamber 124 for after-treatment and chamber 224 for cooling. Each chamber can have a suction and a blowing-out opening for continuous-air operation as shown in FIG. 1. If required, chamber 24 can be used for gentle pre-drying and chamber 124 for subsequent treatment with air at a higher temperature. If required, there can be more than three chambers or only two. In each case, a conveying means in the box-like chambers 6 sends a stream of material for treatment parallel to the drum axis, so that the material automatically runs through one particular air-conditioned zone after another during a preset time, which depends on the actual length of each chamber or the speed of drum 1. The material need not be conveyed from one zone to another through the window-like openings 7 in plates 3 (FIG. 1); instead the plates can be e.g. annular, in which case the material in front of the plate is received in a gap opening free from the inner screen 8 at the top of the inner diameter and conveyed through a chute or pipe transversely through the plate ring to the other side of the plate and thence through a similar slot and distributed among the individual chambers. This however will reduce the sealing effect of the plates unless the chute conveying the material from one chamber to the diagonally opposite chamber is covered by a stationary plate surrounding it and adjacent the plate ring.

As the preceding description shows, in addition to the arrangement of retaining and tensioning devices for a screen, preferably divided longitudinally and/or transversely round the drum periphery, the following features are important:

The drum is divided by plates into at least two portions, corresponding to subdivision of the surrounding casing 2 by intermediate walls 4. The conveyor inside chamber 6 ensures that the material for treatment travels through the chambers without the drums having to move relative to the casing as in a known proposal (German PS No. 1 729 402).

The box-like components for chambers 6 are longitudinally subdivided corresponding to the space between pairs of plates 3, a delivery device, e.g. in the form of window-like opening 7, being provided between neighbouring chambers.

Each element preferably has a polygonal cross-section, and as shown in FIG. 3, one side-wall portion 25 has at least one wall portion 26 which extends parallel to the wall portion of the neighbouring chamber and substantially radially (for deviations see FIG. 7, chambers 506).

Preferably wall portion 26 is adjacent a bent wall portion which preferably extends outwards like portion 127 in FIG. 7, but can also extend inwards like wall sections 227 at the inner side of the chambers in FIG. 7.

Of course, numerous modifications can be made within the scope of the invention. In FIG. 4, for example, a single screen 40 can cover a number of wall portions 108 and 125. If this idea is combined with the connection between screen 10 and the chamber casing suggested for chamber 306 in FIG. 7, the combination can easily be modified by winding a single screen around a chamber casing and tensioning its ends together. In that case one end of the tensioning device will also constitute the retaining device. In this case, there is normally a gap between the two ends of the screen, and therefore the gap will preferably be near a covering side wall (25, 125 or the like). This embodiment is not preferred, however, since if the drum chambers are closely packed at the drum periphery, neighbouring screens may exert considerable friction resulting in folding, damaging the screens and reducing the sealing effect. Alternatively, for example, the retaining device can be spring-mounted, e.g. by securing the quick-acting tensioning fasteners 53 to leaf springs or rubber blocks. Of course, the illustrated individual features can be combined in a wide variety of ways. There are also various uses for the described machine, e.g. for cooling fodder pellets or conveying a granulated adsorbent through a flue gas.

We claim:

1. A dryer, particularly for pasta, comprising a drum having a number of peripheral chambers with conveying devices for the processed material, said drum having an outer periphery and an inner periphery, the chambers being surrounded by a wall, two opposite portions of which face the walls of neighbouring chambers and two other portions are associated with said outer periphery and said inner periphery of the drum, said two other portions of the chamber wall comprising perforated walls, at least the perforated wall at the outer periphery of the drum being movable between two positions, in a first of which it spans and engages said two opposite wall portions which face the walls of neighboring chambers, thereby obstructing access by personnel into the chamber yet enabling circulation of a drying medium through the movable perforated wall, and in a second position of which said movable perforated wall is bodily moved from its said spanning and engaging position to an unobstructing position to permit access into the chamber, and a tensioned retaining means for said movable perforated wall for retaining in tensioned state said perforated wall in said first position thereof when moved to its said first position.

2. A dryer according to claim 1, wherein said movable perforated wall is liftable from at least one of the two opposite wall portions of the chamber when said movable perforated wall is moved from its first position to said second position thereof.

3. A dryer according to claim 1, wherein the wall is formed by a frameless screen net.

4. A dryer according to claim 1, wherein said tensioned retaining means is tensioned by spring means comprising at least one tension spring for biasing the movable perforated wall into its first position.

5. A dryer according to claim 4, wherein the tensioned retaining means is selected from the group consisting of a high-speed tensioning fastener and a snap fastener.

6. A dryer according to claim 1, wherein the tensioned retaining means is disposed between two facing wall portions of neighbouring chambers, the chambers having a substantially polygonal crosssection, each defining a corresponding cavity and being interchangeable components releasably connected to the drum, said chambers being adapted for removal and insertion from the drum after moving said movable perforated wall to its second position.

7. A dryer according to claim 6, wherein said tensioned retaining means is secured to plate means comprising at least three spaced plates disposed along and perpendicular to the drum axis, two of said plates being end plates, the third plate being intermediate said end plates, said plates compartmentalizing said drum into at least two compartments, each containing aligned peripheral chambers, said plate means extending beyond at least the inner drum periphery, means associated with said plates for interconnecting the chambers of said compartments, and means for selective connection of said compartments.

8. A dryer according to claim 1, wherein the movable perforated wall has at least one opening at at least one end thereof for receiving said retaining means in form of a retaining rod extending transversely to the tensioning direction.

9. A dryer, particularly for pasta, comprising a drum having a number of peripheral chambers with conveying devices for the processed material, said drum having an outer periphery and an inner periphery, the chambers being surrounded by a wall, two opposite portions of which face the walls of neighbouring chambers and two other portions are associated with said outer periphery and said inner periphery of the drum, at least three plates disposed along and perpendicular to an axis of the drum, two plates comprising end plates and the remainder being intermediate said end plates and serving as a partition plate, said plates compartmentalizing said drum into at least two compartment sections, each containing peripheral chambers the peripheral chambers in one compartment being aligned with the peripheral chambers in an other compartment, transfer means at said partition plate for transferring material flowing through said chambers in one of said compartments into the aligned chambers of the other compartment, and releasable cooperating means on said plates and chambers for interconnecting said plates with said chambers to form said compartmentalized sections.

* * * * *

UNITED STATES PATENT AND TRADEMARK OFFICE

CERTIFICATE OF CORRECTION

PATENT NO. : 4,688,336

DATED : August 25, 1987

INVENTOR(S) : Friedrich Egger and Andreas Gautschi

It is certified that error appears in the above-identified patent and that said Letters Patent is hereby corrected as shown below:

On the Title Page, Item [30] should read:

[30] Foreign Application Priority Data
Sep. 22, 1983 [CH] Switzerland.....5146/83

Signed and Sealed this

Eighth Day of March, 1988

*Attest:*

DONALD J. QUIGG

*Attesting Officer*

*Commissioner of Patents and Trademarks*